US006776099B1

(12) United States Patent
Landa et al.

(10) Patent No.: US 6,776,099 B1
(45) Date of Patent: Aug. 17, 2004

(54) CENTRAL-INK SUPPLY SYSTEM FOR MULTI-PRINTER SYSTEMS

(75) Inventors: Benzion Landa, Nes-Ziona (IL); Yosef Rosen, Moshav-Sitriya (IL); Amit Henig, Or-Yehuda (IL); Gilad Tzori, Sitriya (IL)

(73) Assignee: Hewlett-Packard Indigo B.V., Maastricht (NL)

( * ) Notice: Subject to any disclaimer, the term of this patent is extended or adjusted under 35 U.S.C. 154(b) by 0 days.

(21) Appl. No.: 10/031,462

(22) PCT Filed: Jul. 18, 1999

(86) PCT No.: PCT/IL99/00394

§ 371 (c)(1),
(2), (4) Date: Jan. 17, 2002

(87) PCT Pub. No.: WO01/06325

PCT Pub. Date: Jan. 25, 2001

(51) Int. Cl.[7] ..... B41F 23/04

(52) U.S. Cl. ..... 101/489; 101/DIG. 37; 399/233; 399/259; 399/57; 355/94

(58) Field of Search ..... 101/489, 335, 101/DIG. 37; 399/233, 57, 259, 236, 222, 112, 223, 224, 237, 241, 250, 246, 247, 254, 258, 58, 262; 355/94

(56) References Cited

U.S. PATENT DOCUMENTS 3,718,155 A * 2/1973 Suzuki et al. ..... 396/620
3,937,177 A * 2/1976 Lloyd ..... 399/247
4,204,766 A * 5/1980 Harada ..... 399/57
4,222,497 A * 9/1980 Lloyd et al. ..... 399/57
4,289,092 A * 9/1981 McChesney ..... 399/247
4,310,238 A * 1/1982 Mochizuki et al. ..... 399/233
4,480,907 A * 11/1984 Vackier ..... 396/604
4,634,252 A * 1/1987 Jeremijevic ..... 399/237
5,258,809 A * 11/1993 Wiedemer ..... 399/112
5,471,287 A * 11/1995 Blair ..... 399/236
5,701,561 A * 12/1997 Speck Hard ..... 399/233
5,708,938 A * 1/1998 Takeuchi et al. ..... 399/250
5,797,074 A * 8/1998 Kasahara et al. ..... 399/262
5,933,685 A * 8/1999 Yoo ..... 399/57
5,963,758 A * 10/1999 Corn et al. ..... 399/57
5,987,273 A * 11/1999 Yamamoto ..... 399/58
6,088,560 A * 7/2000 Zenk et al. ..... 399/237
6,131,002 A * 10/2000 Gibson et al. ..... 399/57
6,154,226 A * 11/2000 York et al. ..... 346/140.1
6,246,424 B1 * 6/2001 Desie et al. ..... 347/124
6,265,883 B1 * 7/2001 Clark ..... 324/713
6,389,244 B1 * 5/2002 Shima et al. ..... 399/58

FOREIGN PATENT DOCUMENTS

DE 3806286 * 8/1989

* cited by examiner

*Primary Examiner*—Eugene H. Eickholt
(74) *Attorney, Agent, or Firm*—Fenster & Company

(57) ABSTRACT

A multi-printer system comprising: a plurality of imaging apparatus, each said apparatus comprising at least one liquid-toner reservoir, containing liquid toner; a central source of toner concentrate; a toner concentrate conduit which connects the central source to the individual imaging apparatus; and at least one toner-concentrate pump which pumps the toner concentrate from the central source to the individual imaging apparatus.

53 Claims, 12 Drawing Sheets

CENTRAL-INK SUPPLY SYSTEM FOR MULTI-PRINTER SYSTEMS

RELATED APPLICATIONS

The present application is a U.S. national application of PCT/IL99/00394, filed 18 Jul. 1999.

FIELD OF THE INVENTION

The present invention relates generally to multi-printer facilities of at least two imaging apparatus (such as printing or copying machines) and in particular, to liquid-toner replenishment systems for multi-printer facilities,

BACKGROUND OF THE INVENTION

Liquid toner for imaging apparatus (such as printing or copying machines) generally contains carrier liquid, toner particles and a minute amount of charge director. Generally, each color of liquid toner is stored in a reservoir from which it is fed to a printing engine for developing images. For good quality printing, proper balance of the three liquid-toner components should be maintained within a narrow band. Depletion of the liquid-toner components is dependent on factors such as the number of prints, the percent of ink coverage of each image and other factors. However, these affect each component differently and each component of the liquid toner depletes at a different rate.

In some prior art systems, replenishment is carried out separately with respect to each component of the liquid toner.

Toner particles are generally replenished in the form of toner concentrate, having a relatively high percentage of particles in liquid carrier. In general, a measurement of the optical density of the liquid toner in the reservoir reveals that the concentration of toner particles has fallen below a predetermined level and that replenishment of toner particles is required.

Carrier liquid is added whenever the liquid toner level in the reservoir falls below a certain level.

Charge director may be added to the toner concentrate. Alternatively or additionally, it may be added to the carrier liquid. Alternatively or additionally, it may be supplied in a separate charge director solution. Charge director is added when the conductivity of the liquid toner is below a predetermined value.

In some systems toner concentrate is replenished from discrete replaceable cartridges, located within the imaging apparatus. Cartridge replacement involves machine downtime and operator attention. Both these factors are costly and inconvenient.

Automatic replenishment of toner concentrate, carrier liquid and charge directors are known.

U.S. Pat. No. 5,231,454, "Charge Director Replenishment System and Method for a Liquid Toner Developing Apparatus," the disclosure of which is incorporated herein by reference, describes an automatic replenishment system for all three liquid toner components, for single, multicolor, imaging apparatus.

U.S. Pat. No. 4,860,924, "Liquid Developer Charge Director Control," the disclosure of which is incorporated herein by reference, describes another system of automatic replenishment for all three components of the liquid toner, wherein again, the replenishment system is individual for single, multicolor, imaging apparatus.

U.S. Pat. No. 5,655,194 "Dispenser Apparatus Especially for Liquid Toner Concentrate," the disclosure of which is incorporated herein by reference, describes apparatus for dispensing liquid-toner concentrate and a container for the liquid-toner concentrate for single, multicolor, imaging apparatus. The system is further described in U.S. Pat. No. 5,558,900 "Liquid Developer System," and U.S. Pat. No. 5,148,222 "Liquid Developer System," the disclosures of which are incorporated herein by reference.

Other liquid developer assemblies are described in U.S. Pat. No. 5,557,376, the disclosure of which is incorporated herein by reference.

Exemplary forms of optical density measurement systems (to determine the need for replenishment of toner-concentrate) are shown in U.S. Pat. Nos. 4,579,253; 4,860,924; 5,793,490; and 5,570,193 the disclosures of all of which are incorporated herein by reference.

An exemplary form of conductivity measurement system (to determine the need for replenishment of charge-director solution) is shown in U.S. Pat. No. 4,860,924 the disclosure of which is incorporated herein by reference.

SUMMARY OF THE INVENTION

According to an aspect of some preferred embodiments of the present invention toner is replenished in individual imaging apparatus in a multi-printer facility from a central toner replenishment system.

In some preferred embodiments of the present invention, the central toner replenishment system comprises a central supply system for toner concentrate.

Preferably, where the multi-printer facility is single-color, the central supply system of toner concentrate comprises one tank of toner concentrate and each imaging apparatus has one liquid-toner reservoir. Preferably, where the multi-printer facility comprises multicolor imaging apparatus or a mixture of multicolor and single-color imaging apparatus, the central supply system of toner concentrate comprises as many as four and possible more tanks of toner concentrate, one for each color, and the multicolor imaging apparatus comprises as many as four and possibly more corresponding liquid-toner reservoirs each.

In some preferred embodiments of the present invention, each liquid-toner reservoir is replenished with toner concentrate directly from the central system. Alternatively, each liquid-toner reservoir comprises a toner-concentrate dispenser can which dispenses toner concentrate to the reservoir, on demand. Preferably, the toner-concentrate dispenser can is continuously replenished from the central system.

An aspect of some preferred embodiments of the present invention is that a multi-printer facility of at least two imaging apparatus comprises a central system of carrier liquid, supplying the individual imaging apparatus.

In preferred embodiments according to this aspect, the liquid-toner reservoirs of the imaging apparatus draw the carrier-liquid directly from the central system and have no carrier-liquid reservoirs. Alternatively, each imaging apparatus has its own carrier-liquid reservoir, which is replenished from the central system, on demand, when the level in the apparatus carrier-liquid reservoir falls below a given value.

In some preferred embodiments of the invention, the central system of carrier liquid supplies carrier liquid for cleaning purposes as well. In preferred embodiments, as described below, in which the individual imaging apparatus have no separate liquid-toner reservoirs, carrier liquid from the central system is supplied only for cleaning purposes.

An aspect of some preferred embodiments of the present invention is that a multi-printer facility of at least two imaging apparatus comprises a central liquid-toner system that supplies the liquid-toner working solution to the individual imaging apparatus, as required.

In preferred embodiments of this aspect, the imaging apparatus draw the liquid-toner working solution for each color directly from the central system and have no liquid toner reservoirs themselves.

Preferably, where the multi-printer facility comprises only single-color imaging apparatus, the central system comprises a single reservoir of liquid-toner working solution. Preferably, where the multi-printer facility comprises multicolor imaging apparatus or a mixture of multicolor and single-color imaging apparatus, the central system comprises as many as four or more reservoirs of liquid-toner working solutions, one for each color.

An aspect of some preferred embodiments of the present invention is that replenishment of charge director to a liquid-toner reservoir is made indirectly, on demand, by adding charge director to a carrier-liquid line just prior to replenishment of carrier liquid to a specific reservoir. This aspect is applicable to multi-printer facilities having central systems of liquid toner and carrier liquid as well as to facilities in which carrier liquid is supplied to each local liquid-toner reservoir from a local carrier liquid reservoir.

In preferred embodiments of this aspect, the carrier-liquid flow, for example, of the order of 50 milliliters per replenishment, is used to carry the charge-director, which is minute, for example, of the order of a few milliliters, from the carrier liquid line to the liquid toner reservoir. In addition to assuring that the proper amount of charge director reaches the reservoir, this method also purges the carrier liquid line so that no excess charge director is supplied to the reservoirs later.

There is thus provided, in accordance with a preferred embodiment of the invention, a multi-printer system comprising:

a plurality of imaging apparatus, each said apparatus comprising at least one liquid-toner reservoir, containing liquid toner;

a central source of toner concentrate;

a toner concentrate conduit which connects the central source to the individual imaging apparatus; and at least one toner-concentrate pump which pumps the toner concentrate from the central source to the individual imaging apparatus.

In a preferred embodiment of the invention, the imaging apparatus each comprise:

a toner-concentrate dispenser which dispenses toner concentrate to said liquid-toner reservoir, wherein the toner concentrate conduit connects the central source to the toner concentrate dispenser, such that toner concentrate is transferred from the central source to the toner concentrate dispenser via the toner concentrate conduit.

Preferably, the system comprises at least one controller.

Preferably, the toner concentrate dispenser comprises a dispenser can; and the can dispenses toner concentrate into the reservoir in response to a command from the at least one controller.

Preferably, the central source of toner concentrate comprises a central container of toner concentrate, containing a concentrate of the same color as a liquid-toner contained in a liquid-toner reservoir of the imaging apparatus; and the toner concentrate conduit is a branching feed line comprising: a junction having an input port and a plurality of output ports; a line connecting the source with the input port and a plurality of lines, each connecting one of the output ports with a different one of the imaging apparatus.

Preferably, a toner-concentrate pump is located on each line connecting the source with an input port. Preferably, the toner-concentrate pump operates continuously. Preferably, the at least one toner-concentrate pump comprises a high-viscosity pump.

In a preferred embodiment of the invention, in the imaging apparatus are multi-colored and the system comprises a plurality of central sources of toner concentrate, each having a different color of toner concentrate. Preferably, the plurality of liquid-toner reservoirs comprises liquid-toner reservoirs of at least yellow, magenta and cyan toner.

In a preferred embodiment of the invention, each liquid-toner reservoir comprises a particle density measurement device that measures a quantity related to the density of toner particles in the liquid toner and sends the measurements to the at least one controller and wherein the at least one controller transfers toner concentrate to the liquid toner reservoir responsive to the measurements.

Preferably, each of the printing apparatus includes:

a carrier-liquid reservoir from which carrier liquid is supplied to the liquid-toner reservoir; and at least one local carrier liquid conduit through which carrier liquid is supplied to the liquid-toner reservoir, responsive to commands from the at least one controller; and the system includes:

a central source of carrier liquid; and a central carrier liquid conduit which carries the carrier liquid to individual ones of the carrier liquid reservoirs responsive to commands from the at least one controller.

There is further provided, in accordance with a preferred embodiment of the invention, a multi-printer system comprising:

a plurality of imaging apparatus, each said apparatus comprising a liquid-toner reservoir;

a central source of carrier liquid;

at least one controller; and a central carrier-liquid conduit which connects the central source of carrier liquid to each of the imaging apparatus and carries carrier liquid to the individual apparatus responsive to a command from the at least one controller.

Preferably, the imaging apparatus includes: a carrier-liquid reservoir from which carrier liquid is supplied to the liquid-toner reservoir, wherein the central carrier liquid conduit carries the carrier liquid to individual ones of the carrier liquid reservoirs responsive to commands from the at least one controller.

Preferably, the central carrier-liquid conduit comprises a branching carrier-liquid feed line, comprising: a proximal end at the central source of carrier liquid; and distal ends at the imaging apparatus.

Preferably, the branching carrier-liquid feed line comprises valves at its distal ends; and the valves are controlled by the at least one controller.

Preferably, the carrier-liquid conduit comprises a pump; and the pump is controlled by the at least one controller.

Preferably, each carrier-liquid reservoir comprises a carrier-liquid level indicator; and measurements of the carrier-liquid level indicator are sent to the at least one controller.

Preferably, each imaging apparatus comprises a conductivity measurement device that measures the conductivity of liquid toner in the liquid toner reservoir, and the system includes:

a source of charge director solution; and at least one charge director solution conduit that communicates between the source of charge director solution and the at least one carrier liquid conduit, wherein a quantity of charge director solution is sent to the reservoir responsive to a low conductivity measurement.

There is further provided, in accordance with a preferred embodiment of the invention, a printer system comprising:

at least one liquid toner reservoir, each said reservoir including a first detector that provides a first signal when the amount of liquid toner therein falls below a given volume and a second detector that measures the conductivity of the liquid toner and produces a second signal responsive thereto;

a source of carrier liquid;

a source of charge director solution;

at least one controller;

at least one carrier liquid conduit that communicates between the source of carrier liquid and the at least one liquid toner reservoir;

at least one charge director solution conduit that communicates between the source of charge director solution and the at least one carrier liquid conduit, wherein the controller is operative to transfer a first quantity of carrier liquid to a liquid toner reservoir via the charge director conduit when the first signal associated with the reservoir indicates a low volume condition for the reservoir and is operative to send a second quantity of charge director solution to the reservoir via the charge-director and carrier-liquid conduits, responsive to the second signal associated with the reservoir indicating a low conductivity condition.

Preferably, in transferring the charge director to the reservoir, the controller is operative to transfer the quantity of charge director solution to the local carrier conduit which charge director solution is then carried by a subsequent transfer of carrier liquid to the reservoir. Preferably, the controller is operative to send the charge director solution to the local carrier liquid conduit immediately prior to sending carrier liquid to the reservoir such that the carrier liquid carries the charge director into the reservoir.

In a preferred embodiment of the invention, the quantity of charge director solution sent to the liquid toner reservoir is substantially less than the quantity of carrier liquid sent to the reservoir.

Preferably, the charge director conduit joins the carrier liquid conduit near an entrance to the reservoir from the carrier liquid conduit.

There is further provided, in accordance with a preferred embodiment of the invention, a multi-printer system comprising:

a plurality of imaging apparatus, each said apparatus comprising:

a printing engine a liquid-toner inlet line from which fresh liquid toner is fed to the printing engine;

a central source of liquid toner;

a liquid-toner feed which connects the central source to the liquid-toner inlet line;

at least one controller which transfers fresh liquid toner from the central source, via said feed.

Preferably, each imaging apparatus includes:

a liquid-toner exhaust line which collects discharged liquid toner from the printing engine and delivers it to the central source.

Preferably, the liquid-toner feed is a branching feed line comprising:

a junction;

a first feed line connecting the central source with the junction; and a plurality of second feed lines connecting the junction with respective liquid-toner inlet lines of the imaging apparatus.

Preferably each of said plurality of feed lines includes a valve controlled by the at least one controller.

Preferably, the imaging apparatus are multi-colored; and a liquid-toner inlet line comprises a plurality of liquid-toner inlet lines.

Preferably, the central source of liquid toner is multi-colored, comprising a plurality of central containers of liquid toner of different colors. Preferably, the plurality of liquid-toner containers comprises liquid-toner containers of at least yellow, magenta and cyan toner.

In a preferred embodiment of the invention, the system includes:

a central source of carrier liquid; and a carrier liquid conduit that connects the central source to the individual imaging apparatus, wherein the at least one controller is operative to transfer carrier liquid from the central source of carrier liquid to the individual imaging apparatus as required by the apparatus for cleaning.

Preferably, the system includes a carrier-liquid pump that pumps carrier-liquid to respective imaging apparatus responsive to commands from said at least one controller.

Preferably, the system includes a carrier liquid return conduit that collects carrier liquid after use by the imaging device and transfers it to the central source of carrier liquid.

Preferably, the system includes a separator that removes toner particles from the collected carrier liquid prior to its delivery to the central source of carrier liquid.

There is further provided, in accordance with a preferred embodiment of the invention, a multi-printer system comprising:

a plurality of imaging apparatus;

a central source of carrier liquid;

at least one controller;

a central carrier-liquid conduit which connects the central source of carrier liquid to each of the imaging apparatus and carries carrier liquid to the individual apparatus responsive to a command from the at least one controller.

Preferably, the system includes a carrier-liquid exhaust line which collects discharged carrier liquid from the imaging apparatus and returns it to the central source of carrier liquid.

Preferably, the imaging apparatus comprise electrostatographic imaging apparatus.

Preferably, the imaging apparatus comprise electrophotographic apparatus.

In a preferred embodiment of the invention, the imaging apparatus comprise printers. In a preferred embodiment of the invention, the imaging apparatus comprise copiers.

There is further provided, in accordance with a preferred embodiment of the invention, a method of dispensing toner concentrate in a multi-printer facility comprising a plurality of imaging apparatus, each said apparatus comprising a liquid toner reservoir, the method comprising:

providing a central source of toner concentrate; and automatically transferring toner concentrate from said central source to individual imaging apparatus.

In a preferred embodiment of the invention, transferring comprises transferring toner concentrate directly to a liquid-toner reservoir of the individual imaging apparatus, in response to a deficiency of toner concentrate in the reservoir.

In a preferred embodiment of the invention, transferring comprises transferring toner concentrate to a liquid-toner concentrate dispenser associated with a liquid-toner reservoir in the individual imaging apparatus.

There is further provided, in accordance with a preferred embodiment of the invention, a method of providing liquid toner in a multi-printer facility comprising a plurality of imaging apparatus, comprising:

providing a central source of liquid toner; and automatically transferring liquid toner from said central source to individual imaging apparatus in response to a need of liquid toner in said imaging apparatus.

There is further provided, in accordance with a preferred embodiment of the invention, a method of providing carrier liquid in a multi-printer facility comprising a plurality of imaging apparatus, comprising: providing a central source of carrier liquid; and automatically transferring carrier liquid from said central source to individual imaging apparatus in response to a need of carrier liquid in said imaging apparatus.

BRIEF DESCRIPTION OF THE DRAWINGS

The present invention will be more clearly understood from the following detailed description of the preferred embodiments of the invention and from the attached drawings, in which same number designations are maintained throughout the figures for the same element and in which.

DETAILED DESCRIPTION OF PREFERRED EMBODIMENTS

Figure 1A:
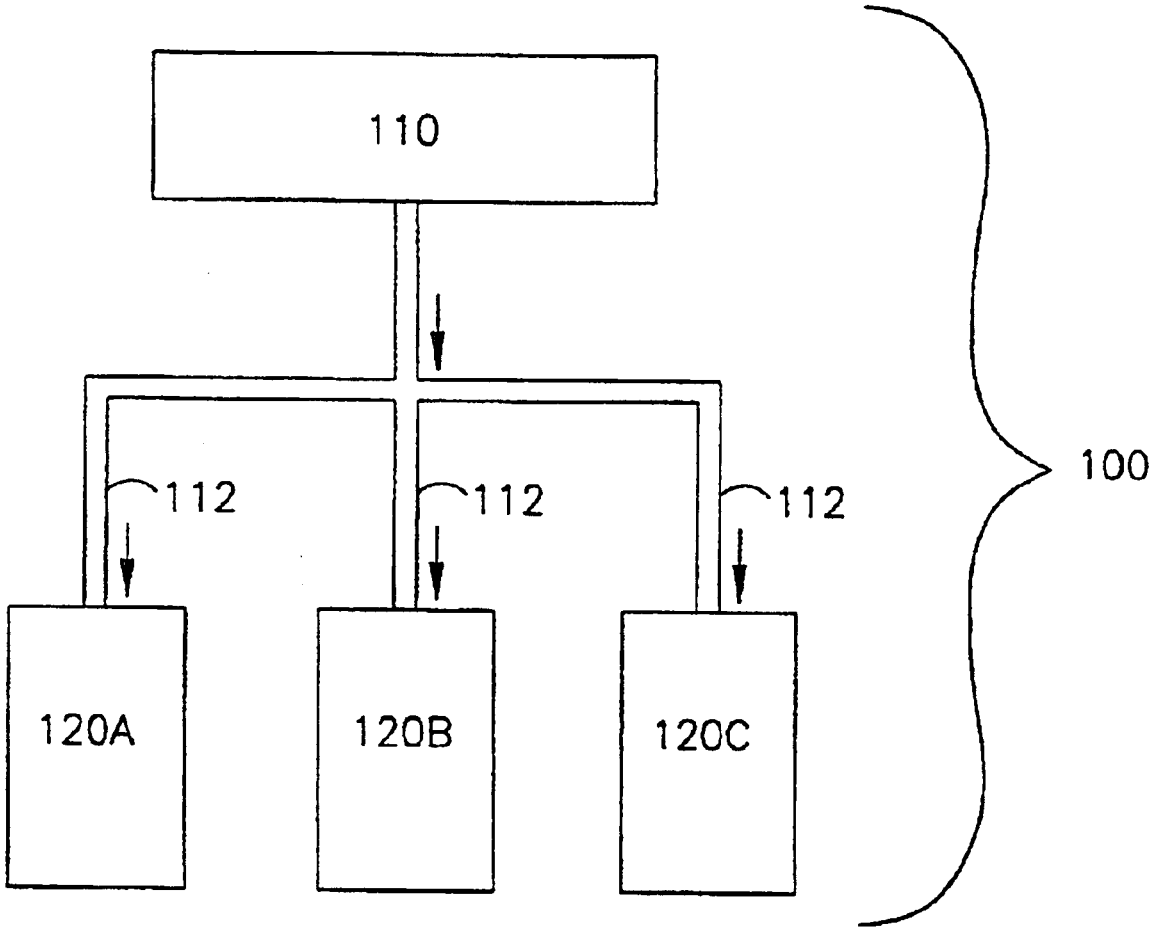
FIG. 1A is a schematic block diagram of a multi-printer facility, in accordance with a preferred embodiment of the present invention.
Figure 1B:
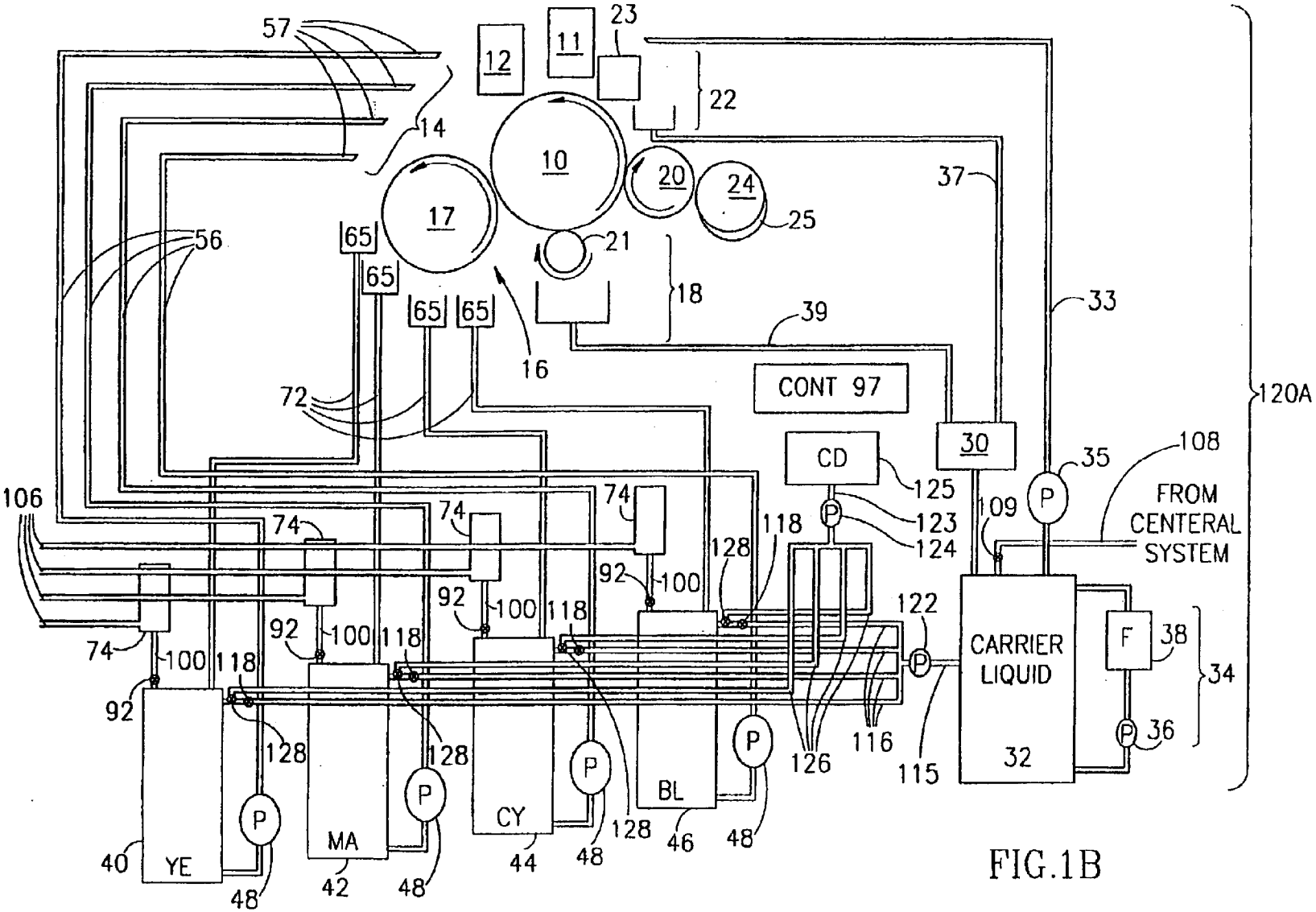
FIG. 1B is a schematic block diagram of multicolor, electrostatic, imaging apparatus, in accordance with a preferred embodiment of the present invention.
Figure 1C:
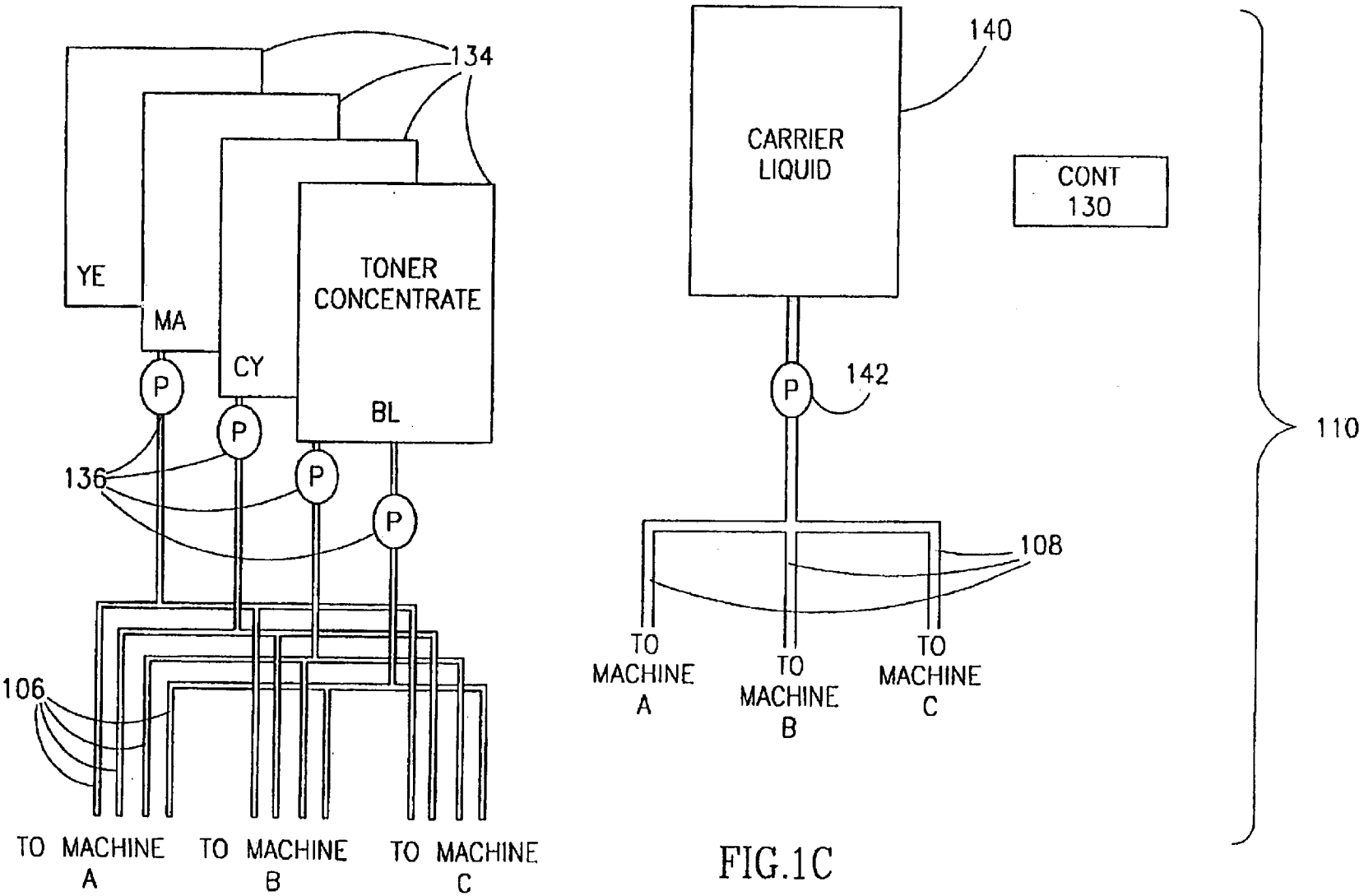
FIG. 1C is a schematic block diagram of a central replenishment system in accordance with a preferred embodiment of the present invention.

Reference is now made to FIGS. 1A, 1B and 1C, which are schematic block diagrams of a multi-printer facility 100, in accordance with a preferred embodiment of the present invention. FIG. 1A illustrates multi-printer facility 100, which comprises a central system 110 in communication with 3 multicolor, electrostatic, imaging apparatus 120A, 120B and 120C via feed lines 112. FIG. 1B illustrates single imaging apparatus 120A. FIG. 1C illustrates central system 110.

FIG. 1B is a schematic block diagram of multicolor, electrostatic, imaging apparatus 120A in accordance with a preferred embodiment of the present invention. Preferably, imaging apparatus 120A comprises an image bearing surface, typically embodied in a rotating photoconductive drum 10. Associated with photoconductive drum 10 is photoconductor charging apparatus 11. Also associated with photoconductive drum 10 is imaging apparatus 12, for example, a laser scanner, for providing a desired latent image on drum 10. The latent image normally includes image areas at a first electrical potential and background areas at another electrical potential.

Photoconductive drum 10, photoconductor charging apparatus 11 and imaging apparatus 12 may be any suitable drum, charging apparatus and imaging apparatus as are well known in the art. Preferred photoreceptors, are, for example, those described in U.S. Pat. No. 5,376,491 or in PCT published application WO 96/07955. For example, charging apparatus as described in published PCT application WO 94/22059 or unpublished PCT application PCT/IL98/00553 may be used.

Preferably, associated with photoconductive drum 10 are an intermediate transfer member 20, a cleaning station 22 and an excess liquid removal assembly 18.

Intermediate transfer member 20, cleaning station 22 and excess liquid removal assembly 18, may be any suitable intermediate transfer member, cleaning station and excess liquid removal assembly as are well known in the art Intermediate transfer member 20 may be for example, one of the intermediate transfer members described in one of U.S. Pat. Nos. 5,089,856; 5,572,274; 5,410,392; 5,592,269; 5,745,829; PCT published PCT applications WO 97/07433; WO 98/55901; WO 96/13760; and unpublished PCT applications PCT/IL/98/00576; and PCT/IL98/00553. Preferred cleaning station, useful in the practice of the present invention are described in U.S. Pat. No. 4,439,035 and unpublished PCT application PCT/IL98/00553, the disclosure of which is incorporated herein by reference. Pre-transfer excess liquid removal and discharge mechanisms useful in the present invention are described, for example, in U.S. Pat. Nos. 4,286,039; 5,276,492; 5,572,274; 5,166,734; 5,854,960.

In preferred embodiments of the invention a pre-transfer erase mechanism may be present, such as that described in U.S. Pat. No. 5,166,734.

Preferably, intermediate transfer member 20 is arranged for electrostatic transfer of the image from the image-bearing surface. Intermediate transfer member 20 is preferably associated with a impression roller 24 for transfer of the image onto a further substrate 25, such as paper, preferably mounted on roller 24, preferably by heat and pressure.

Preferably, after developing each image in a given color, the developed single-color image is transferred to intermediate transfer member 20. Subsequent images in different colors are sequentially transferred onto intermediate transfer member 20. When all the desired images have been transferred thereto, the complete multicolor image is transferred from transfer member 20 to substrate 25. Therefore, impression roller 24 produces operative engagement between intermediate transfer member 20 and substrate 25 only when transfer of the composite image to substrate 25 takes place.

Alternatively, each single color image is transferred to the paper after its formation. In this case, the single color images are transferred seriatim to the paper. Alternatively, intermediate transfer member 20 is omitted and the developed single color images are transferred sequentially directly from drum 10 to substrate 25.

Preferably, cleaning station 22 receives supply of clear carrier liquid from a carrier liquid reservoir 32 via a supply conduit 33 and a carrier liquid pump 35. Preferably, the carrier liquid used by cleaning station 22 and drum 10 and is collected and returned to reservoir 32 through a conduit 37.

Preferably, the carrier liquid collected by excess liquid removal assembly 18 is returned to reservoir 32 through conduit 39.

In some preferred embodiments, a separator 30 is used to separate any toner particles from the used carrier liquid of conduits 37 and 39. Clean carrier liquid is supplied from separator 30 to carrier-liquid reservoir 32. Separator 30 may be any separator as known in the art. In some preferred embodiments, separator 30 is of the type described in U.S. Pat. No. 4,985,732, the disclosure of which is incorporated herein by reference.

Alternatively or additionally, carrier liquid from reservoir 32 circulates continuously through a filtering system 34 comprising a pump 36 and a filter 38.

Alternatively or additionally, a filter (for example a 10 micron filter) is used after pump 35 to remove solid material in the carrier liquid. Preferably, a pressure drop across the filter is measured and the magnitude of the pressure is used as an indication of whether the filter should be replaced.

Also associated with photoconductive drum 10 is a multicolor liquid developer assembly 16 which includes a developer roller electrode 17, spaced from photoconductive drum 10 and preferably rotating in the same sense as drum 10. This rotation provides for the surfaces of drum 10 and roller 17 to have opposite velocities in their region of propinquity. Developer assembly 16 also includes multicolor, liquid-toner supply assembly 14, for providing colored toner to develop latent images on photoconductive drum 10.

In some preferred embodiments of the invention, multicolor, liquid-toner supply assembly 14 is a single-engine assembly which receives separate supplies of colored liquid toner from four different reservoirs 40, 42, 44 and 46, typically containing yellow, magenta, cyan and black liquid toners respectively. Four pumps 48 are provided at the entrances of the four supply conduits 56 for providing a desired amount of pressure to feed the colored liquid toner to a series of four spray nozzles 57. The colored liquid toners are collected into a series of four collection trays 65 and returned to the proper reservoirs through a series of four collection conduits 72. Preferred developer systems of the type described above, useful in the present invention are described, for example in U.S. Pat. Nos. 5,028,964; 5,231,454; 5.289,238; 5,148,222; 5,255,058; 5,117,263 or published PCT application WO 96/29633, the disclosures of all of which are incorporated by reference. Preferably, toner of the general type described in U.S. Pat. No. 4,794,651 is desirable for use in the present invention. Moreover, U.S. Pat. Nos. 4,980,259; 5,555,185; 5,047,306; 5,572,274; 5,410,392; 5,436,706; 5,225,306; 5,266,435; 5,610,694; 5,346,796; 5,737,666; 5,745,829; 5,908,729; 5,300,390; 5,264,313; and PCT published applications WO 92/17823; WO 95/04307; WO 96/01442; WO 96/01442; WO 96/13760; WO 96/26469; WO 96/31809, the disclosures of all of which are incorporated by reference, describe preferred toners and charge directors for use in the present invention.

Alternative development systems, suitable for the present invention include those described in U.S. Pat. Nos. 5,436,706; 5,610,694; 5,737,666 and in PCT published application WO 96/31809, the disclosures of all of which are incorporated by reference. Alternatively other toner and development systems, known in the art may be used.

However, the invention is not limited to a multicolor system of four colors. In some preferred embodiments, additional reservoirs containing additional colors, such as green, violet and/or orange, or special toners such as gold or silver may be added, each with its own supply conduit, nozzle, pump and collection conduit. Nor is the invention limited to any specific construction shown (for this or its other embodiments). In particular, it should be understood that all liquid toner systems known in the art are generally suitable for use in the various embodiments of the invention and that the system described is used as an example, for convenience, since it is well known to the inventors.

Preferably, a controller 97 is associated with imaging apparatus 120A. Controller 97 preferably receives signals from indicators and measuring devices of imaging apparatus 120A and preferably controls all pumps and all valves of imaging apparatus 120A. However, to avoid cluttering the figure, no lines are shown connecting the controller to the other elements.

Preferably, associated with each liquid-toner reservoir 40, 42, 44 and 46, there are toner concentrate dispenser units 74, for replenishing the liquid-toner reservoirs with toner concentrate when required. Dispenser units 74 are similar in design to the toner-concentrate dispenser can described in U.S. Pat. No. 5,655,194 "Dispenser Apparatus Especially for Liquid Toner Concentrate," the disclosure of which is incorporated herein by reference.

However, in the prior art, dispenser cans used for replenishing the liquid-toner reservoirs were in themselves disposable, and their replacement is inconvenient. Whereas dispenser cans 74, of the embodiment of FIG. 1B, unlike the prior art, are refilled automatically from a central system.

Figure 2A:
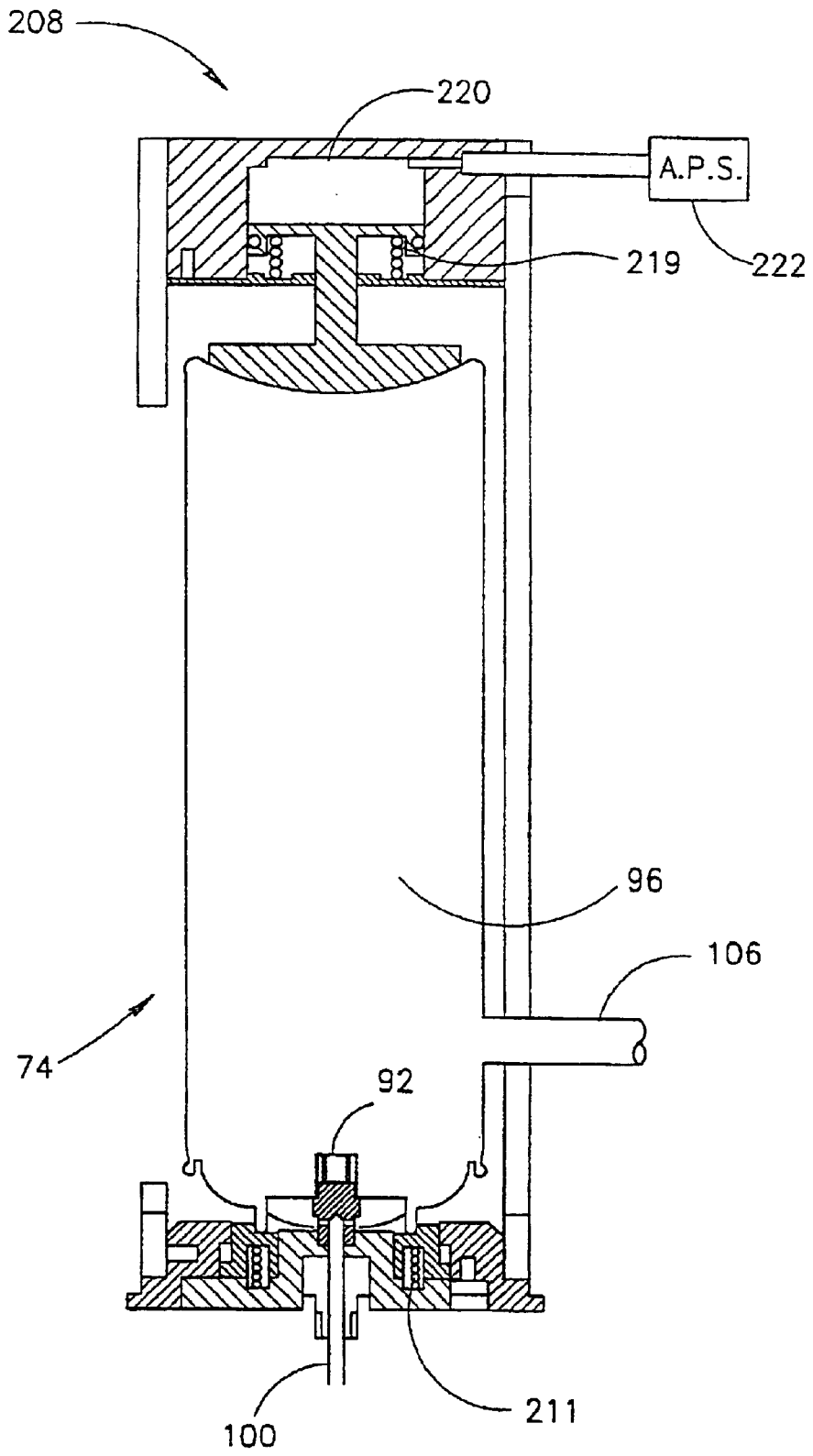
FIGS. 2A and 2B are side sectional illustrations of a liquid-toner concentrate dispenser can in two operative positions, in accordance with a preferred embodiment of the present invention.
Figure 2B:
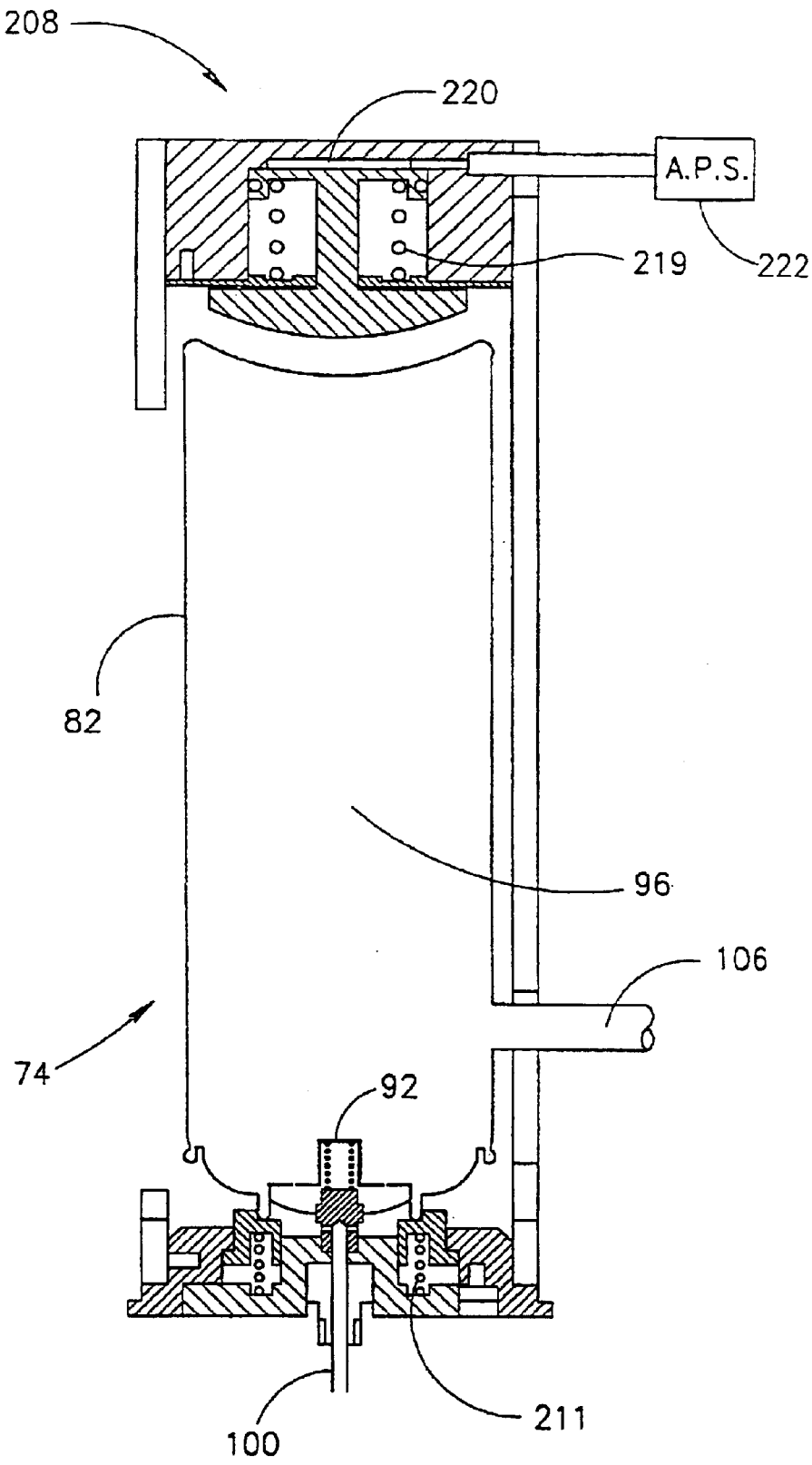

Reference is now made to FIGS. 2A and 2B which are schematic diagrams of refillable toner-concentrate dispenser can 74 in accordance with a preferred embodiment of the present invention.

Preferably, dispenser can 74 comprises a housing 82 that is similar in construction to the housing of a commercially available aerosol spray can. Activation of an air pressure source 222, in response to a signal from controller 97, results in an ingress of pressurized air into a space 220, pressing against springs 219 and pushing down piston 91. In consequence, piston 91 presses housing 82 against springs 211, thereby pushing in and opening spring-loaded valve 92. The liquid-toner concentrate inside housing 82 is continuously under constant, high pressure. Therefore, when valve 92 opens, a measured amount of toner concentrate is discharged from a space 96, via feed line 100, to a liquid toner reservoir such as reservoir 40. This open position is illustrated in FIG. 2A. After a predetermined time period, operation of air pressure source 222 is suspended, and pressurized air is removed from a region 220. The drop in air pressure within region 220 to the ambient air pressure, results in axial movement of housing 82 and piston 91 towards an end portion 208, due to the tension release effect of springs 211 and 219, thereby closing valve 92 and bringing can 74 to the closed position shown in FIG. 2B.

In a preferred embodiment of the invention, dispenser can 74 comprises a feed line 106 (shown on FIGS. 2A, 2B and on FIGS. 1B and 1C), through which dispenser can 74 is kept full of toner concentrate at high pressure. Preferably, line 106 is of a flexible material, at least near dispenser can 74, in order to accommodate the travel incurred by line 106 and housing 82 in the opening and closing of valve 92. Preferably, the toner concentrate in line 106 is constantly under high pressure by pump 136. In consequence, volume 96 of dispenser can 74 is likewise constantly under high pressure. Alternatively, but less preferably, line 106 has a valve, and dispenser can 74 is refilled at intervals, for example, at constant time intervals.

Figure 3:
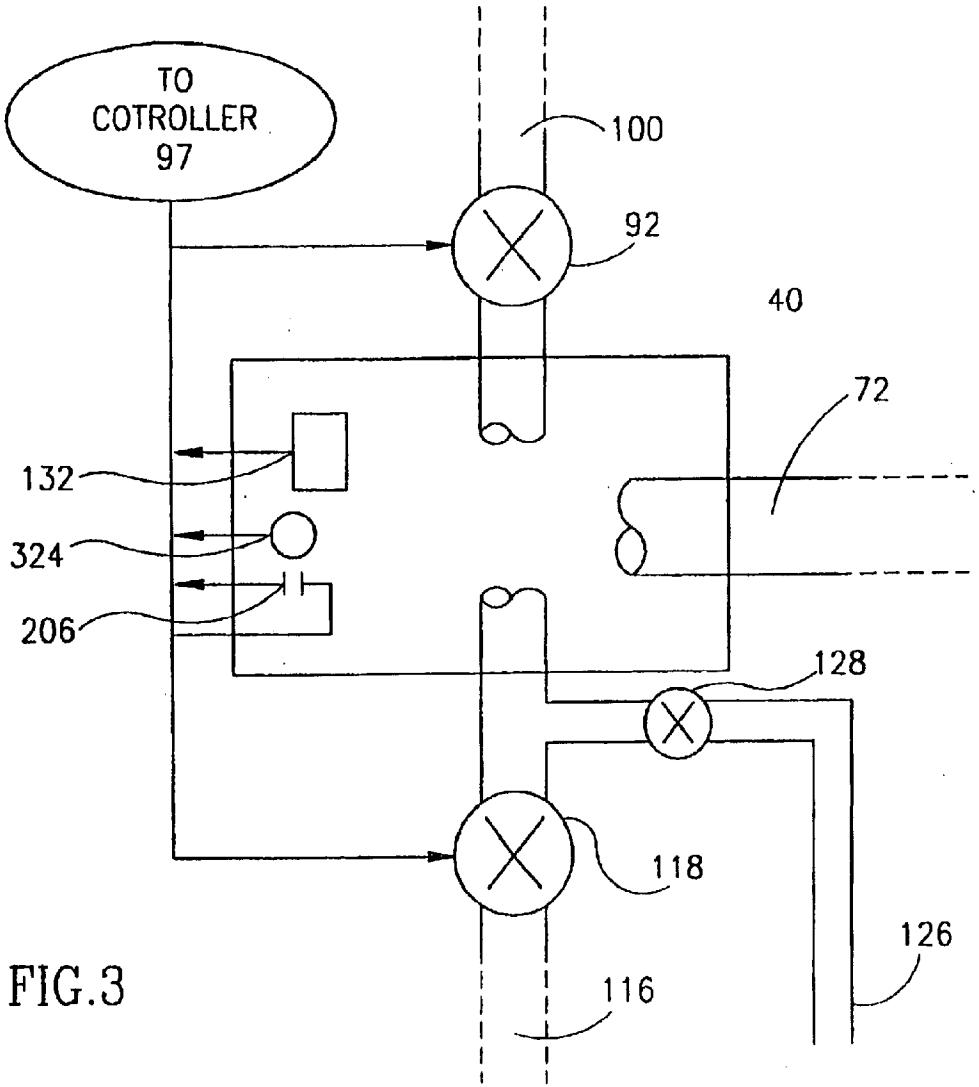
FIG. 3 is a schematic illustration of a liquid-toner reservoir, in accordance with a preferred embodiment of the invention.

Reference is now made to FIG. 3 which schematically illustrates a reservoir 40 of imaging apparatus 120A, in accordance with a preferred embodiment of the invention, for example, containing yellow toner. Preferably, the other liquid-toner reservoirs are substantially identical in structure. Preferably, liquid-toner reservoir 40 comprises a device for measuring optical density 132, in order to determine if replenishment of toner concentrate is required. Preferably, device 132 is similar in design to any of the prior art designs described in the background section. Alternatively, device 132 may be any device for measuring concentration of toner particles in the liquid toner, as known in the art. Preferably, device 132 measures the optical density continuously. Alternatively, device 132 measures the optical density periodically. Preferably, device 132 sends signals to controller 97 indicating the optical density and by inference, the toner particle concentration. Preferably, when controller 97 receives a signal that yellow liquid-toner reservoir 40 requires replenishment of toner concentrate, it activates air pressure source 222, thereby opening valve 92 of feed line 100 of yellow toner-concentrate dispenser can 74 (shown also on FIG. 1B). In this manner, only a single reservoir, in this case, yellow liquid-toner reservoir 40, is replenished with toner concentrate from yellow dispenser can 74.

In preferred embodiments of the invention, the toner concentrate contains a pre-determined concentration of charge directors, generally less than that required for proper charging of the liquid toner.

Preferably, as shown in FIG. 1B, liquid-toner reservoirs 40, 42, 44 and 46 and carrier-liquid reservoir 32 are in communication with each other so that when the volume of liquid-toner in any reservoir is low, it is refilled from carrier liquid reservoir 32.

Preferably, as shown in FIG. 3, liquid-toner reservoirs 40 comprise a device 324, as known in the art, for measuring the level of liquid in a reservoir, in order to determine if an addition of carrier liquid is required. Preferably, device 324 measures the level of liquid continuously. Alternatively, device 324 measures the level of liquid periodically. Preferably, when the level of liquid in reservoir 40 is low, device 324 sends a signal to controller 97.

Preferably, as shown in FIG. 1B, when controller 97 receives a signal that yellow liquid-toner reservoir 40 requires replenishment of carrier liquid, it activates a pump 122 of a line 115, (which branches out to four lines 116 leading to the four liquid-toner reservoirs) and opens one of four valves 118 (on lines 116), in particular valve 118 associated with yellow reservoir 40, so that yellow reservoir 40 is replenished with carrier liquid.

Preferably, reservoir 32 also comprises a similar device 324. Preferably, when the level of liquid in reservoir 32 is low, device 324 of reservoir 32 sends a signal to controller 97 that refilling is required. Refilling from central system 110, via feed line 108 will be described below.

In a preferred embodiment of the invention, as shown in FIG. 1B, imaging apparatus 120A comprises a charge-director tank 125 for replenishing the liquid-toner reservoirs with charge director.

Preferably, as shown in FIG. 3, liquid-toner reservoir 40 comprises a device 206 for measuring the conductivity of the liquid toner in reservoir 40, in order to determine if replenishment of charge director is required. Preferably, device 206 measures the conductivity continuously. Alternatively, device 206 measures the conductivity periodically. Preferably, when the conductivity is low, device 206 sends a signal to controller 97.

Preferably, as shown in FIG. 1B, replenishment of charge director from tank 125 to the liquid-toner reservoirs is carried out in conjunction with replenishment of carrier liquid, because of the very minute quantity of charge director that is required. Preferably, when controller 97 receives a signal that yellow liquid-toner reservoir 40 requires replenishment of charge-director, it stores the information until it receives a signal that yellow liquid-toner reservoir 40 also requires replenishment of carrier liquid.

At that point, controller 97 activates a pump 124 of a line 123, (which branches out to four lines 126 leading to four carrier-liquid lines 116). Controller 97 also opens one of the four valves 128, in particular, valve 128 associated with yellow reservoir 40. Replenishment of charge director is made to the one carrier-liquid line 116 that leads to yellow reservoir 40. Controller 97 then activates pump 122 of line 115 and opens valve 118 of line 116 associated with yellow reservoir 40. In this manner, the flow of carrier liquid from reservoir 32 to yellow reservoir 40 carries with it the required amount of charge director to yellow reservoir 40. Preferably, the outlets of charge-director lines 126 to carrier-liquid lines 116 are very close to the outlets of carrier-liquid lines 116 to reservoirs 40–46. This is desirable since the quantity of carrier liquid dispensed, while much greater than that of the charge director solution, is still relatively small. Such placement assures that all of the charge director solution is flushed from the feed lines and into the respective reservoir by the carrier liquid.

In some preferred embodiments, the outlets of charge-director lines 126 to carrier-liquid lines 116 is on the liquid-toner-reservoir sides of valves 118. Less preferably, the outlets of charge-director lines 126 to carrier-liquid lines 116 is on the carrier-liquid-reservoir side of valves 118.

It should be understood that while the above automatic charge-director dispensing apparatus is described in the context of a local charge director dispenser, associated with individual imaging apparatus, this mechanism and method are equally applicable to a central charge director dispensing system, as described below.

Reference is now made to FIG. 1C which is a schematic block diagram of central system 110 in communication with three imaging apparatus 120A, 120B and 120C, in accordance with a preferred embodiment of the present invention.

Preferably, central system 110 comprises four tanks 134 of toner concentrates for the four respective colors. Preferably, associated with each tank there is a high viscosity pump 136 for high-viscosity materials such as Blagdon Hopper-type pump model 15-1/2". Preferably, associated with each tank are feed lines 106 to the four refillable dispenser can 74 of each imaging apparatus (shown on FIG. 1A).

As shown in FIG. 1C, central system 110 preferably further comprises a carrier-liquid tank 140. Associated with the carrier liquid tank there is a pump 142, feed lines 108 to the carrier-liquid reservoirs of each imaging apparatus 120 and a valve 109, near the outlet to reservoir 32 of each imaging apparatus 120 (shown on FIG. 1A).

Preferably, central system 110 further comprises a controller 130 which receives signals and information from individual controllers 97 of each imaging apparatus 120 and which controls pump 142 of central system 110 and valves 109 of each imaging apparatus 120. (To avoid cluttering the figure, no lines are shown connecting controller 130 to the other elements.)

Note that in the preferred embodiments, pumps 136 operate constantly, so that lines 106 and dispenser cans 74 are maintained at high pressure, constantly. Alternatively or additionally, central controller 130 and imaging apparatus controllers 97 work together is some other manner to control the pumps and valves of the central system and of the individual imaging apparatus. Alternatively or additionally, appropriate circuitry is used in place of or in addition to central controller 130 and imaging apparatus controllers 97.

Preferably, as device 324 of carrier-liquid reservoir 32 of imaging apparatus 120A sends a signal to imaging apparatus controller 97 that reservoir 32 is low in carrier liquid, controller 97 sends a signal to central controller 130 of central system 110.

Preferably, central controller 130 activates pump 142 of carrier-liquid tank 140 and opens valve 109 of carrier-liquid feed line 108. In this manner, carrier-liquid reservoir 32 of imaging apparatus 120A is replenished with carrier liquid Note that, except for central feed lines 106, central feed line 108 and valve 109, imaging apparatus 120A is similar to any prior art imaging apparatus. Thus, imaging apparatus 120A may be any prior art liquid toner imaging apparatus that is fitted with central feed lines 106 and 108.

It should be noted that, while the embodiment of FIGS. 1–3 include central supply of toner concentrate, carrier liquid and charge director, other preferred embodiments of the invention may have any one or two of these components supplied centrally and the other(s) supplied locally, at each printer. Furthermore, while the above embodiment shows toner concentrate delivered first from a central source to a local dispenser, in some preferred embodiments of the invention, the toner concentrate may be delivered directly to the liquid toner reservoirs. In preferred embodiments wherein the toner concentrate is delivered from the central system directly to the liquid toner reservoirs, each line 106 has a valve, and controller 97 opens the valve of a particular liquid-toner reservoir whenever replenishment of toner concentrate to that reservoir is required. Preferably, the valve is open for a predetermined interval, so as to control the amount of toner concentrate that is dispensed.

Figure 4A:
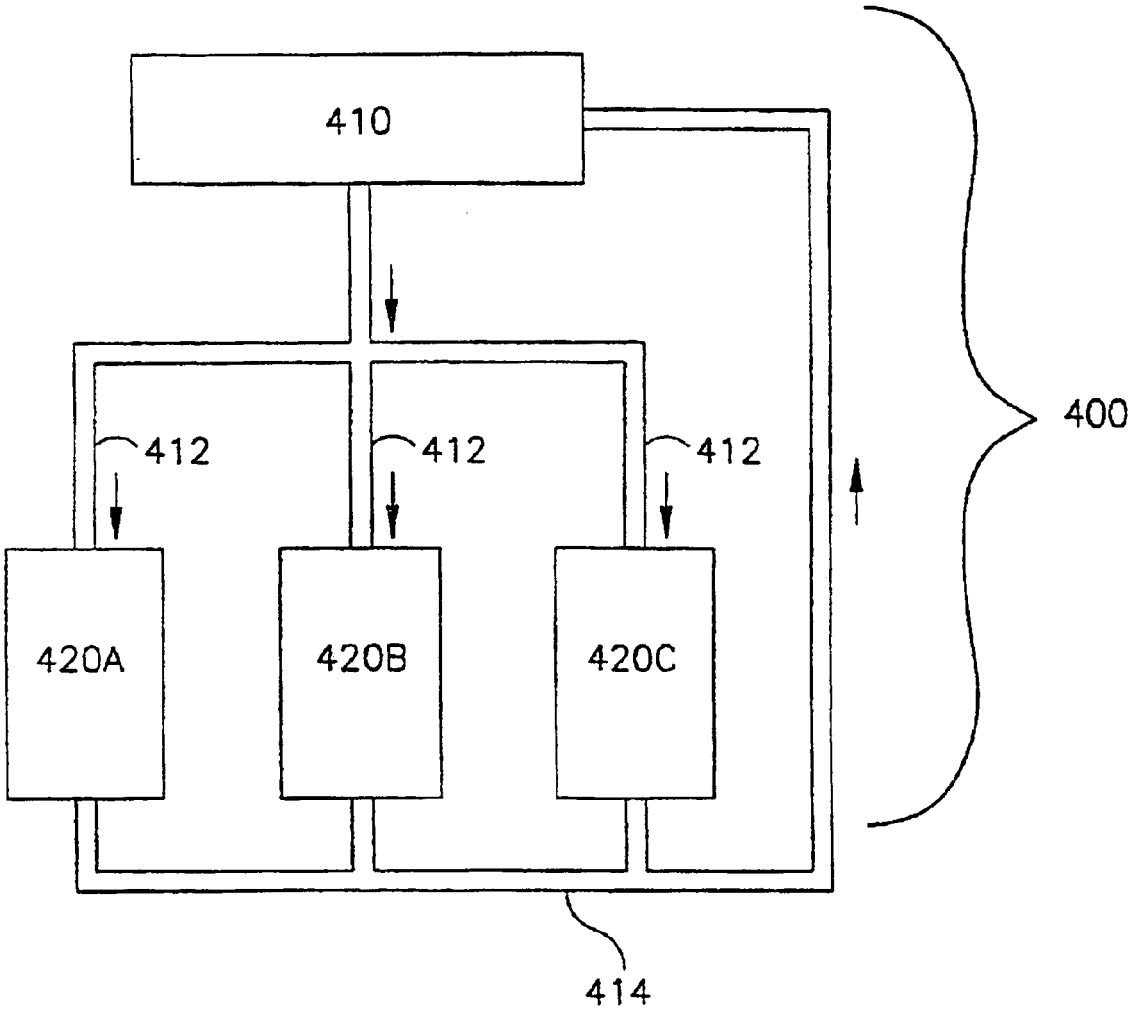
FIG. 4A is a schematic block diagram of another multi-printer facility, in accordance with a preferred embodiment of the present invention.
Figure 4B:
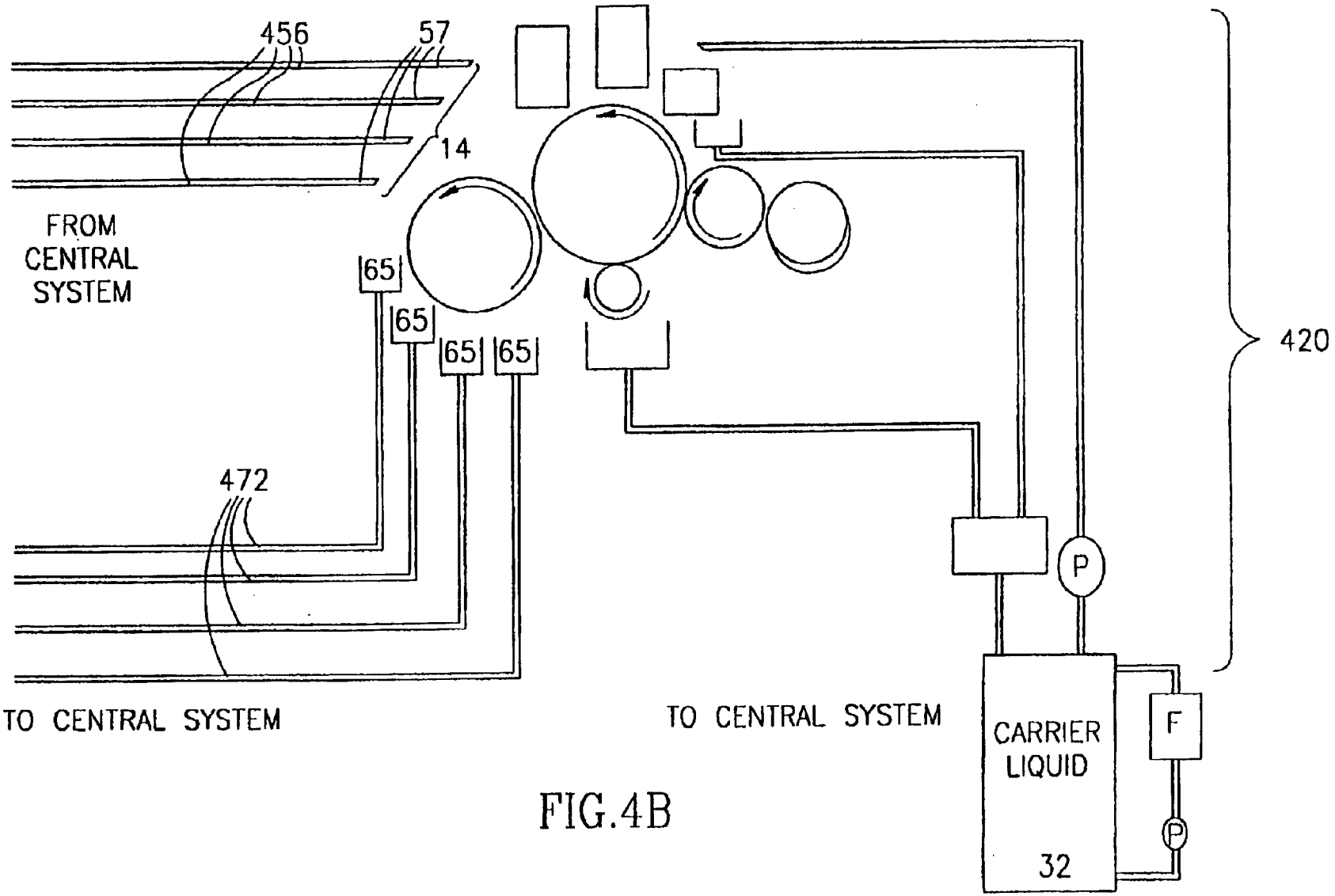
FIG. 4B is a schematic block diagram of another multicolor, electrostatic, imaging apparatus, in accordance with a preferred embodiment of the present invention.
Figure 4C:
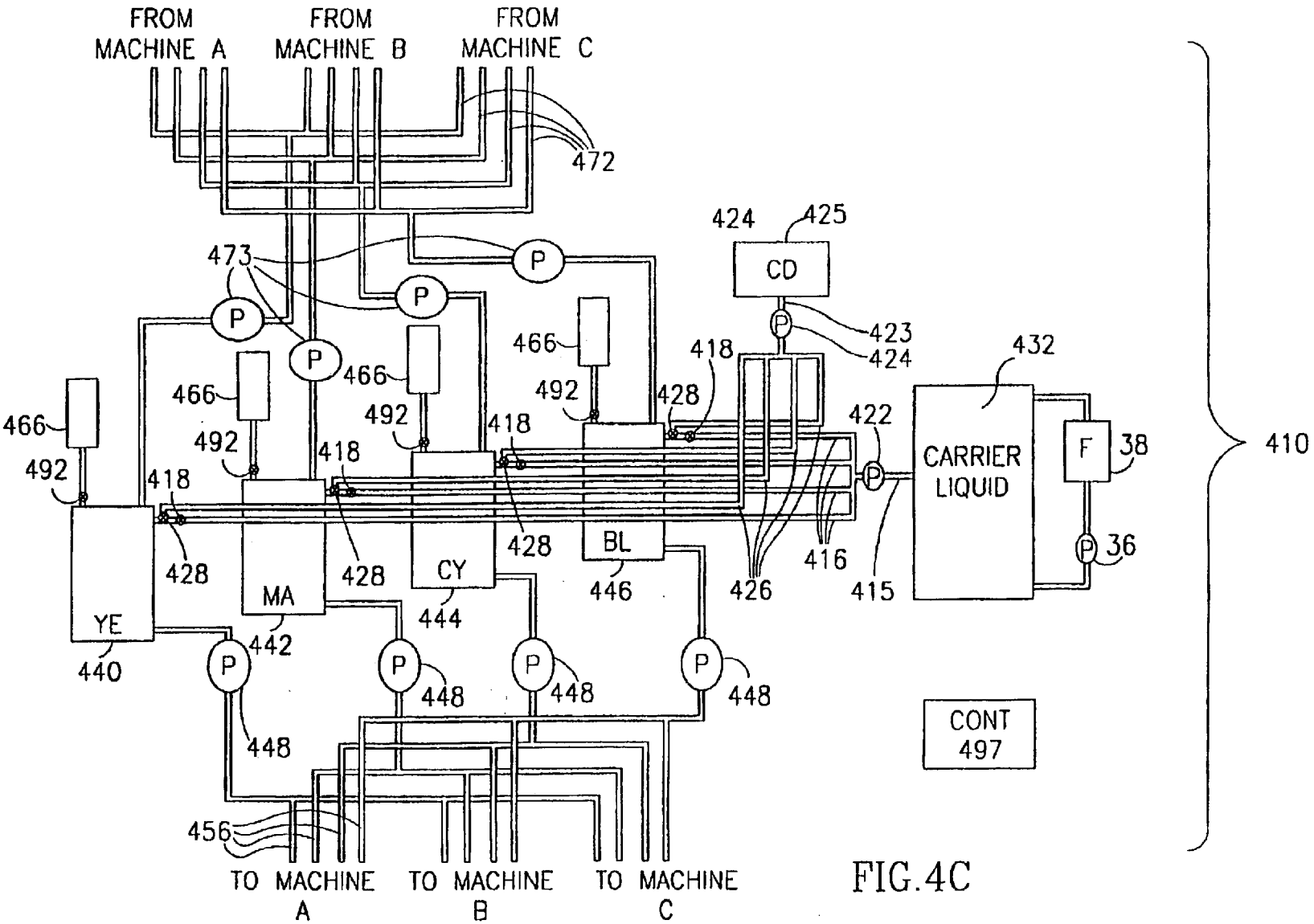
FIG. 4C is a schematic block diagram of another central supply system in accordance with a preferred embodiment of the present invention.

Reference is now made to FIGS. 4A, 4B and 4C which are schematic block diagrams of a multi-printer facility 400 in accordance with another preferred embodiment of the present invention. FIG. 4A illustrates multi-printer facility 400 which comprises a central system 410 in communication with 3 identical multicolor, electrostatic, imaging apparatus 420A, 420B and 420C via feed lines 412 and 414. FIG. 4B illustrates single imaging apparatus 420A. FIG. 4C illustrates central system 410.

Preferably, in system 400, imaging apparatus 420A, 420B and 420C do not have their own liquid-toner reservoirs. Rather, working liquid toner of the different colors is supplied directly from central system 410, via central feed lines 456 to spray nozzles 57. Preferably, four central pumps 448 are provided at the entrances of central feed lines 456 for providing a desired amount of pressure to feed the colored liquid toner to a series of spray nozzles 57 of imaging apparatus 420A. Preferably, the pumps work continuously and valves are provided at each unit, controlled by a local controller. Within imaging apparatus 420A, used liquid toner of the different colors is collected into a series of collection trays 65 and returned to the proper central reservoirs through a series of central collection conduits 472. Four central pumps 473 provide the desired amount of pressure to collect the colored liquid toners.

An advantage of this system over the embodiments of FIGS. 1–3 is that the liquid toner is not subject to the environment within the imaging apparatus, for example, the heat that is generated by the printing or copying process. Rather, the liquid toner may be kept in a more easily controlled, more optimal environment.

Preferably, central system 410 of colored liquid toner reservoirs is similar in design to the colored liquid-toner reservoirs of imaging apparatus 120A, and comprises a carrier-liquid reservoir 432 for replenishing liquid toner reservoirs 440, 442, 444 and 446 with carrier liquid. Preferably, central system 410 also comprises a charge-director tank 425 for replenishing the liquid toner reservoirs with charge director. Preferably, each of liquid-toner reservoirs 440, 442, 444 and 446 comprises a device 324 for measuring the liquid level within the reservoir. Preferably, each of the liquid-toner reservoirs comprises a device 206 for measuring the conductivity within each reservoir. Preferably, a controller 497 receives signals from the different measuring devices and controls pump 422 and valves 418 of carrier-liquid lines 416 and pump 424 and valves 428 of charge-director lines 426, in the same manner as described above.

In some preferred embodiments of the invention, central liquid toner reservoirs 440, 442, 444 and 446 are replenished with colored toner concentrate from dispenser cans 466 which comprise valves 492 and which may be similar in design to the dispenser cans described in U.S. Pat. No. 5,655,194 "Dispenser Apparatus Especially for Liquid Toner Concentrate," the disclosure of which is incorporated herein by reference. Alternatively, central liquid toner reservoirs 440, 442, 444 and 446 are replenished with colored toner concentrate from a system of tanks such as toner-concentrate tanks 134 of FIG. 1C and pumps such as heavy viscosity pumps 136 of FIG. 1C. Preferably, each of liquid-toner reservoirs 440, 442, 444 and 446 comprises device 132 for measuring the optical density of the liquid toner within the reservoir. Preferably, a controller 497 receives signals from device 132 and activates the valves necessary for the replenishment.

In some preferred embodiments, central system 410 comprises more than four colored liquid toner reservoirs and includes special colors, for example, gold or silver, metallic colors or other process colors such as purple, orange and (or) green.

Figure 5A:
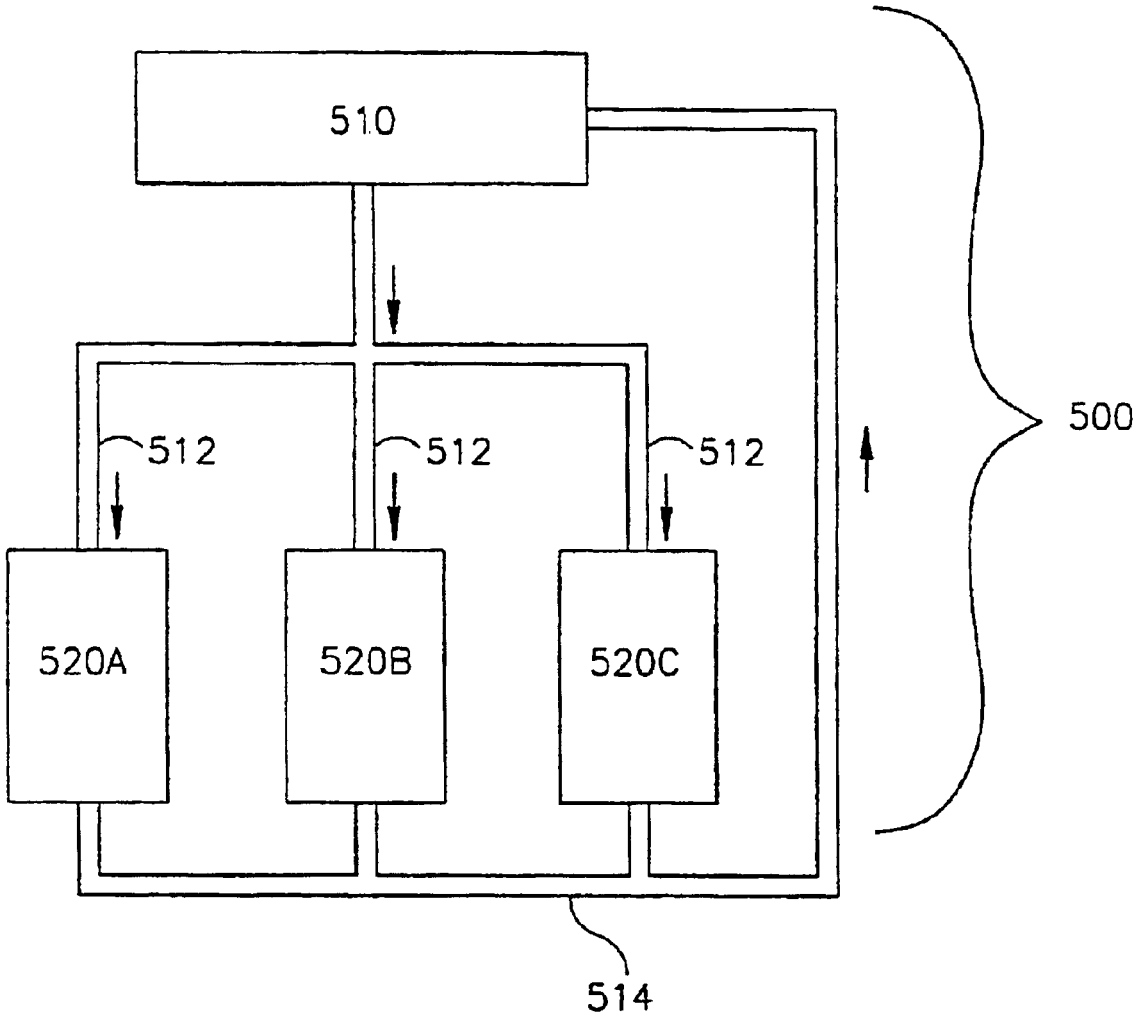
FIG. 5A is a schematic block diagram of still another multi-printer facility, in accordance with a preferred embodiment of the present invention.
Figure 5B:
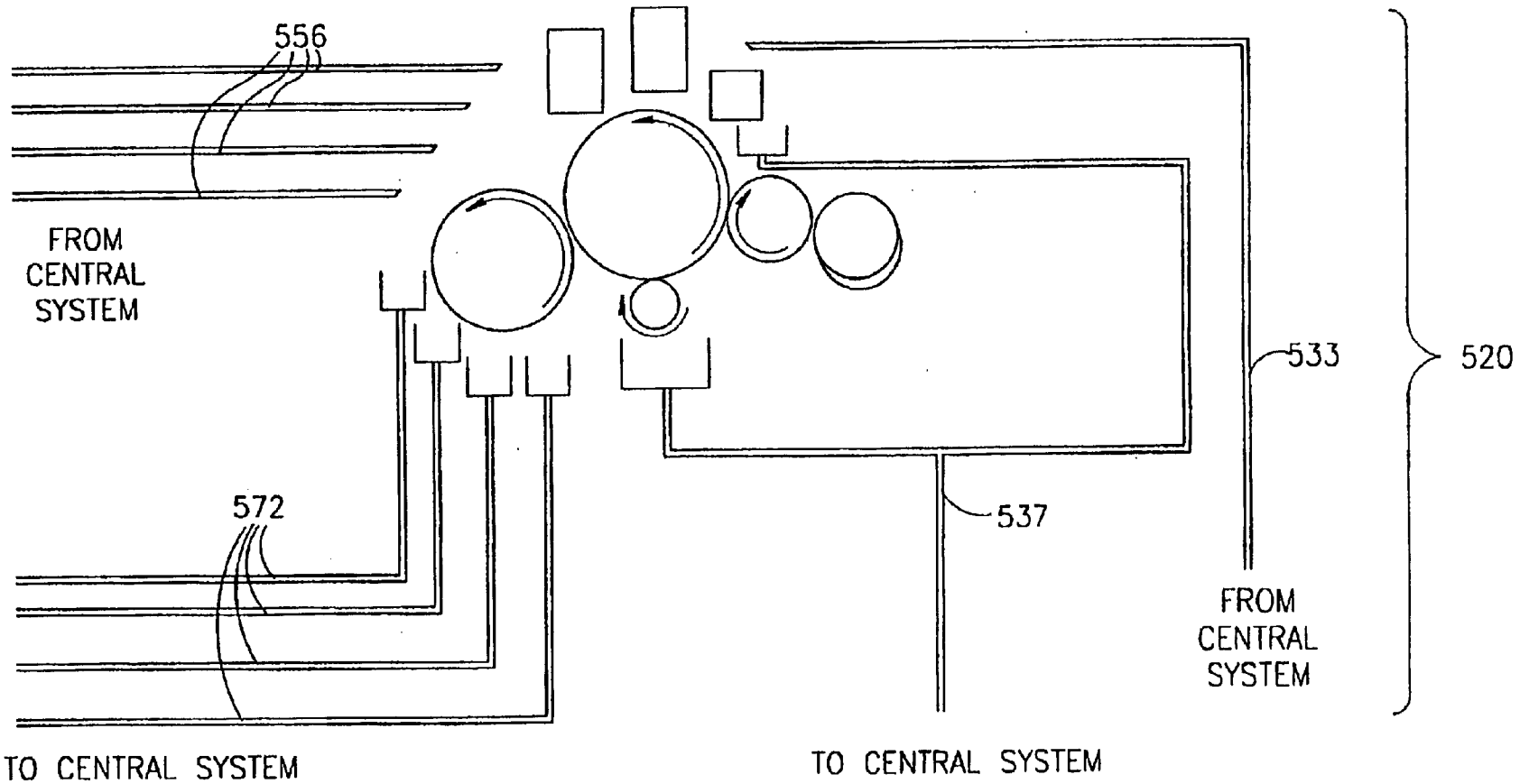
FIG. 5B is a schematic block diagram of still another multicolor, electrostatic, imaging apparatus, in accordance with a preferred embodiment of the present invention.
Figure 5C:
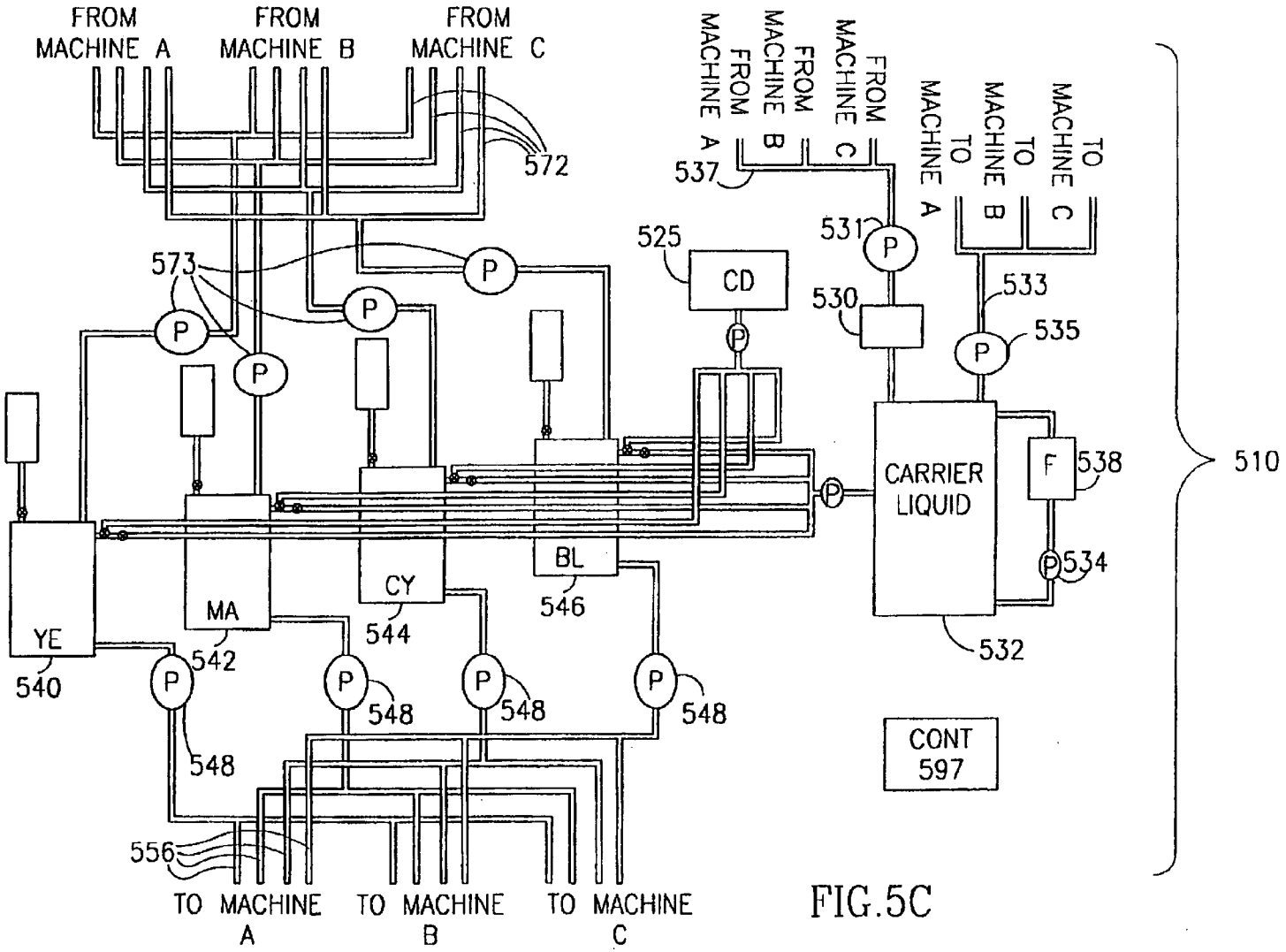
FIG. 5C is a schematic block diagram of still another central system in accordance with a preferred embodiment of the present invention.

Reference is now made to FIGS. 5A, 5B and 5C which are schematic block diagrams of a multi-printer facility 500 in accordance with another preferred embodiment of the present invention. FIG. 5A illustrates multi-printer facility 500 which comprises a central system 510 in communication with 3 identical multicolor, electrostatic, imaging apparatus 520A, 520B and 520C via feed lines 512 and 514. FIG. 5B illustrates single imaging apparatus 520A. FIG. 5C illustrates central system 510.

Preferably, in system 500, imaging apparatus 520A does not have liquid-toner reservoirs. Furthermore, imaging apparatus 520A does not have a carrier-liquid reservoir. Imaging apparatus 520A receives working liquid toner and carrier liquid from central system 510. Preferably, working liquid toner is supplied to imaging apparatus 520A from central liquid toner reservoirs 540, 542, 544 and 546 via feed lines 556 and central pumps 548, as described with respect to FIGS. 4A–4C. Preferably, used liquid toner is collected and returned to central system 510 via feed lines 572 and central pumps 573, as described with respect to 4A–4C. Preferably, carrier liquid is supplied to imaging apparatus 520A from central carrier-liquid reservoir 532 via feed line 533 and central pump 535. Preferably, carrier liquid is returned to central system 510 via feed line 537 and central pump 531. Preferably, the carrier liquid is passed through a central separator 530 before returning to central carrier-liquid reservoir 532. Alternatively or additionally, the carrier liquid of reservoir 532 is passed through a continuous filtering system comprising a filter 538 and a pump 534, or a filter at the output of the reservoir.

Preferably, central carrier-liquid reservoir 532 also replenishes central liquid toner reservoirs 540, 542, 544 and 546 with carrier liquid when necessary, as controlled by controller 597. This system operates in much the same way as the carrier liquid replenishment of FIGS. 1–3.

Preferably, a central charge-director tank 525 replenishes central liquid toner reservoirs 540, 542, 544 and 546 with charge director when necessary, as controlled by controller 597. This system operates in much the same way as the charge director replenishment of FIGS. 1–3.

Preferably, central liquid toner reservoirs 540, 542, 544 and 546 comprises a toner-concentrate replenishment system as controlled by controller 597. This system operates in much the same way as the toner concentrate replenishment of FIG. 4B.

In some preferred embodiments, central system 510 comprises more than four colored liquid toner reservoirs and includes special colors, for example, gold or silver, metallic colors or other process colors such as purple, orange and (or) green.

The present invent invention is not limited to the specific systems described. Rather, any combination of the features that have been described may be used. Alternatively, some features that have been described may be left out. It should be noted that, while the embodiments of FIGS. 1–3 include central supply of toner concentrate, carrier liquid and charge director, other preferred embodiments of the invention may have any one or two of these components supplied centrally and the other(s) supplied locally, at each printer. Furthermore, while the above embodiment shows toner concentrate delivered first from a central source to a local dispenser, in some preferred embodiments of the invention, the toner concentrate may be delivered directly to the liquid toner reservoirs.

The present invention has been described using non-limiting detailed descriptions of preferred embodiments thereof that are provided by way of example and are not intended to limit the scope of the invention. Variations of embodiments described will occur to persons of the art. In particular, while a specific liquid toner imaging apparatus utilizing specific elements has been used for illustrative purposes, the imaging apparatus, including the structure of a printing engine or engines used therein may be of any suitable kind. Since, in general, all or nearly all liquid toner imaging apparatus require replenishment of one or more of toner concentrate, carrier liquid and charge director, the present invention is applicable to such apparatus, even if not referenced or described herein. The terms "comprise," "include," and "have" or their conjugates, when used herein, mean "including but not necessarily limited to." The scope of the invention is limited only by the following claims.

What is claimed is:

1. A multi-printer system comprising:

a plurality of imaging apparatus, each said apparatus comprising at least one liquid-toner reservoir, containing liquid toner;

a central source of toner concentrate;

a toner concentrate conduit which connects the central source to the individual imaging apparatus; and at least one toner-concentrate pump which pumps the toner concentrate from the central source to the individual imaging apparatus.

2. A system according to claim 1 in which the imaging apparatus each comprise:

a toner-concentrate dispenser which dispenses toner concentrate to said liquid-toner reservoir, wherein the toner concentrate conduit connects the central source to the toner concentrate dispenser, such that toner concentrate is transferred from the central source to the toner concentrate dispenser via the toner concentrate conduit.

3. A system according to claim 2 and comprising at least one controller.

4. A system according to claim 3, wherein:

the toner concentrate dispenser comprises a dispenser can; and the can dispenses toner concentrate into the reservoir in response to a command from the at least one controller.

5. A system according to claim 3 wherein:

the central source of toner concentrate comprises a central container of toner concentrate, containing a concentrate of the same color as a liquid-toner contained in a liquid-toner reservoir of the imaging apparatus; and the toner concentrate conduit is a branching feed line comprising:

a junction having an input port and a plurality of output ports;

a line connecting the source with the input port; and a plurality of lines, each connecting one of the output ports with a different one of the imaging apparatus.

6. A system according to claim 5 wherein a toner-concentrate pump is located on each line connecting the source with an input port.

7. A system according to claim 6 wherein the toner-concentrate pump operates continuously.

8. A system according to claim 3 wherein the at least one toner-concentrate pump comprises a high-viscosity pump.

9. A system according to claim 3 wherein the imaging apparatus are multi-colored and comprising a plurality of central sources of toner concentrate, each having a different color of toner concentrate.

10. A system according to claim 9 wherein the plurality of liquid-toner reservoirs comprises liquid-toner reservoirs of at least yellow, magenta and cyan toner.

11. A system according to claim 3 wherein each liquid-toner reservoir comprises a particle density measurement device that measures a quantity related to the density of toner particles in the liquid toner and sends the measurements to the at least one controller and wherein the at least one controller transfers toner concentrate to the liquid toner reservoir responsive to the measurements.

12. A system according to claim 3 wherein:

each of the printing apparatus includes:

a carrier-liquid reservoir from which carrier liquid is supplied to the liquid-toner reservoir; and at least one local carrier liquid conduit through which carrier liquid is supplied to the liquid-toner reservoir, responsive to commands from the at least one controller; and the system includes:

a central source of carrier liquid; and a central carrier liquid conduit which carries the carrier liquid to individual ones of the carrier liquid reservoirs responsive to commands from the at least one controller.

13. A system according to claim 1 wherein the imaging apparatus comprise electrostatographic imaging apparatus.

14. A system according to claim 1 wherein the imaging apparatus comprise electrophotographic apparatus.

15. A system according to claim 1 wherein the imaging apparatus comprise printers.

16. A system according to claim 1 wherein the imaging apparatus comprise copiers.

17. A method of dispensing toner concentrate in a multi-printer facility comprising a plurality of imaging apparatus, each said apparatus comprising a liquid toner reservoir, the method comprising:

providing a central source of toner concentrate; and automatically transferring toner concentrate from said central source to individual imaging apparatus.

18. A method according to claim 17 wherein transferring comprises transferring toner concentrate directly to a liquid-toner reservoir of the individual imaging apparatus, in response to a deficiency of toner concentrate in the reservoir.

19. A method according to claim 17 wherein transferring comprises transferring toner concentrate to a liquid-toner concentrate dispenser associated with a liquid-toner reservoir in the individual imaging apparatus.

20. A method of providing liquid toner in a multi-printer facility comprising a plurality of imaging apparatus, comprising:

providing a central source of liquid toner; and automatically transferring liquid toner from said central source to individual imaging apparatus in response to a need of liquid toner in said imaging apparatus.

21. A method of providing carrier liquid in a multi-printer facility comprising a plurality of imaging apparatus, comprising:

providing a central source of carrier liquid; and automatically transferring carrier liquid from said central source to individual separate printers in response to a need of carrier liquid in said imaging apparatus.

22. A method according to claim 20 wherein the individual imaging apparatus each have valves to control the flow of liquid toner to the individual imaging apparatus.

23. A method according to claim 20 wherein the individual imaging apparatus each have valves to control the flow of liquid toner to develop latent images on a photoreceptor of said apparatus.

24. A method according to claim 21 and including:

printing multi-color images on at least some of said separate printers.

25. A multi-printer system comprising:

a plurality of separate printers;

a central source of carrier liquid;

at least one controller;

a central carrier-liquid conduit which connects the central source of carrier liquid to each of the separate printers and carries carrier liquid to the separate printers responsive to a command from the at least one controller.

26. A system according to claim 25 and including a carrier-liquid exhaust line which collects discharged carrier liquid from the separate printers and returns it to the central source of carrier liquid.

27. A system according to claim 25 wherein each said separate printer comprises at least one liquid-toner reservoir.

28. A system according to claim 27 wherein each separate printer includes:

a carrier-liquid reservoir from which carrier liquid is supplied to the at least one liquid-toner reservoir, wherein the central carrier liquid conduit carries the carrier liquid to individual ones of the carrier liquid reservoirs responsive to commands from the at least one controller.

29. A system according to claim 27 wherein the central carrier-liquid conduit comprises a branching carrier-liquid feed line, comprising:

a proximal end at the central source of carrier liquid; and distal ends at the separate printers.

30. A system according to claim 29 wherein:

the branching carrier-liquid feed line comprises valves at its distal ends; and the valves are controlled by the at least one controller.

31. A system according to claim 29 wherein:

the carrier-liquid conduit comprises a pump; and the pump is controlled by the at least one controller.

32. A system according to claim 27 wherein:

each carrier-liquid reservoir comprises a carrier-liquid level indicator; and measurements of the carrier-liquid level indicator are sent to the at least one controller.

33. A system according to claim 27 wherein each separate printer comprises a conductivity measurement device that measures the conductivity of liquid toner in the at least one liquid toner reservoir; and including:

a source of charge director solution; and at least one charge director solution conduit that communicates between the source of charge director solution and the at least one carrier liquid conduit, wherein a quantity of charge director solution is sent to the at least one reservoir responsive to a low conductivity measurement.

34. Apparatus according to claim 25 wherein each of said separate printers is a multicolor printer.

35. A printer system comprising:

at least one liquid toner reservoir, each said reservoir including a first detector that provides a first signal when the amount of liquid toner therein falls below a given volume and a second detector that measures the conductivity of the liquid toner and produces a second signal responsive thereto;

a source of carrier liquid;

a source of charge director solution;

at least one controller;

at least one carrier liquid conduit that communicates between the source of carrier liquid and the at least one liquid toner reservoir;

at least one charge director solution conduit that communicates between the source of charge director solution and the at least one carrier liquid conduit, wherein the controller is operative to transfer a first quantity of carrier liquid to a liquid toner reservoir via the carrier-liquid conduit when the first signal associated with the reservoir indicates a low volume condition for the reservoir and is operative to send a second quantity of charge director solution to the reservoir via the charge-director and carrier-liquid conduits, responsive to the second signal associated with the reservoir indicating a low conductivity condition.

36. A system according to claim 35 wherein, in transferring the charge director to the reservoir, the controller is operative to transfer the quantity of charge director solution to a local carrier liquid conduit from which it is carried by a subsequent transfer of carrier liquid to the reservoir.

37. A system according to claim 36 wherein the controller is operative to send the charge director solution to the local carrier liquid conduit immediately prior to sending carrier liquid to the reservoir such that the carrier liquid carries the charge director into the reservoir.

38. A system according to claim 35 wherein the quantity of charge director solution sent to the liquid toner reservoir is substantially less than the quantity of carrier liquid sent to the reservoir.

39. A system according to claim 38 wherein the charge director conduit joins the carrier liquid conduit near an entrance to the reservoir from the carrier liquid conduit.

40. A multi-printer system comprising:

a plurality of imaging apparatus, each said apparatus comprising:

a printing engine a liquid-toner inlet line from which fresh liquid toner is fed to the printing engine;

a central source of liquid toner;

a liquid-toner feed which connects the central source to the liquid-toner inlet line;

at least one controller which transfers fresh liquid toner from the central source, via said feed.

41. A system according to claim 40 wherein each imaging apparatus includes:

a liquid-toner exhaust line which collects discharged liquid toner from the printing engine and delivers it to the central source.

42. A system according to claim 41 wherein the liquid-toner feed is a branching feed line comprising:

a junction;

a first feed line connecting the central source with the junction; and a plurality of second feed lines connecting the junction with respective liquid-toner inlet lines of the imaging apparatus.

43. A system according to claim 42 wherein:

each of said plurality of feed lines includes a valve controlled by the at least one controller.

44. A system according to claim 40 wherein:

the imaging apparatus are multi-colored; and a liquid-toner inlet line comprises a plurality of liquid-toner inlet lines.

45. A system according to claim 40 wherein the central source of liquid toner is multi-colored, comprising a plurality of central containers of liquid toner of different colors.

46. A system according to claim 45 wherein the plurality of liquid-toner containers comprises liquid-toner containers of at least yellow, magenta and cyan toner.

47. A system according to claim 40 and including:

a central source of carrier liquid; and a carrier liquid conduit that connects the central source to the individual imaging apparatus, wherein the at least one controller is operative to transfer carrier liquid from the central source of carrier liquid to the individual imaging apparatus as required by the apparatus for cleaning.

48. A system according to claim 47 and including a carrier-liquid pump that pumps carrier-liquid to respective imaging apparatus responsive to commands from said at least one controller.

49. A system according to claim 47 and including a carrier liquid return conduit that collects carrier liquid after use by the imaging device and transfers it to the central source of carrier liquid.

50. A system according to claim 49 and including a separator that removes toner particles from the collected carrier liquid prior to its delivery to the central source of carrier liquid.

51. A method of providing liquid toner in a multi-printer facility comprising a plurality of printers, comprising:

providing a central source of liquid toner; and automatically transferring liquid toner from said central source to separate printers in response to a need of liquid toner in said imaging apparatus at said printers.

52. A method according to claim 51 wherein the separate printers each have valves to control the flow of liquid toner thereto.

53. A method according to claim 51 wherein the separate printers each have valves to control the flow of liquid toner to develop latent images on a photoreceptor thereof.

* * * * *